US007665214B2

(12) United States Patent
Okabe

(10) Patent No.: US 7,665,214 B2
(45) Date of Patent: Feb. 23, 2010

(54) ROTARY ELECTRIC SHAVER

(75) Inventor: Masaki Okabe, Matsumoto (JP)

(73) Assignee: Izumi Products Company, Nagano (JP)

( * ) Notice: Subject to any disclaimer, the term of this patent is extended or adjusted under 35 U.S.C. 154(b) by 129 days.

(21) Appl. No.: 11/601,909

(22) Filed: Nov. 20, 2006

(65) Prior Publication Data

US 2007/0113408 A1 May 24, 2007

(30) Foreign Application Priority Data

Nov. 21, 2005 (JP) ..... 2005-336116

(51) Int. Cl.
*B26B 19/14* (2006.01)

(52) U.S. Cl. ..... 30/43.4; 30/43.5; 30/43.6

(58) Field of Classification Search ..... 30/43.4–43.6
See application file for complete search history.

(56) References Cited

U.S. PATENT DOCUMENTS

| | | | | |
|---|---|---|---|---|
| 4,240,199 | A * | 12/1980 | Boiten et al. | 30/43.6 |
| 4,275,497 | A * | 6/1981 | Engelhardt et al. | 30/43.6 |
| 4,283,849 | A | 8/1981 | Engelhardt et al. | |
| 4,329,781 | A * | 5/1982 | Schemmann et al. | 30/34.2 |
| 5,390,416 | A * | 2/1995 | Uchiyama et al. | 30/43.6 |
| 2005/0120567 | A1 * | 6/2005 | Okabe | 30/43.6 |

FOREIGN PATENT DOCUMENTS

| | | | |
|---|---|---|---|
| EP | 0713752 | | 5/1996 |
| EP | 1537963 | A1 * | 6/2005 |
| EP | 1787767 | A1 * | 5/2007 |
| GB | 2008468 | | 6/1979 |
| GB | 2036629 | | 7/1980 |
| JP | 10-323461 | | 12/1998 |
| JP | 2005185827 | A * | 7/2005 |
| JP | 2005-230237 | | 9/2005 |
| JP | 2007135991 | A * | 6/2007 |

* cited by examiner

*Primary Examiner*—Jason Daniel Prone
(74) *Attorney, Agent, or Firm*—William L. Androlia; H. Henry Koda

(57) ABSTRACT

A rotary electric shaver including a disc-shaped outer cutter 10, which is mounted in the upper part of a shaver main body housing therein a motor and has ring-shaped tracks 18 on the under (inner) surface thereof, and an inner cutter 12A, which has cutter blades 120 that elastically contact the ring-shaped tracks 18 of the outer cutter 10 from below and is rotated by the motor; and in this shaver, the inner cutter 12A has vibration elements 132 that travel in the ring-shaped tracks 18 and have a smaller spring constant, compared to the cutter blade 120, in the direction same as and opposite from the direction in which the cutter blades travel, and the vibration elements 132 vibrate and produce sound when, during shaving, they strike stoppers 134 provided near the vibration elements 132.

11 Claims, 6 Drawing Sheets

ROTARY ELECTRIC SHAVER

BACKGROUND OF THE INVENTION

1. Field of the Invention

The present invention relates to a rotary electric shaver in which a rotating inner cutter with its cutter blades elastically in contact with a ring-shaped track of a substantially disc-shaped outer cutter cuts whiskers (hair) entering into the hair introduction openings formed in the outer cutter.

2. Description of the Related Art

When an electric shaver is used, vibration and noise are produced by the motor and drive system built installed in the shaver body, and, together therewith, noise (cutting noise, shaving noise, frictional noise, and the like) is produced by the vibration accompanying the friction between the outer cutter and the inner cutter and the vibration of the blades when the hair (whiskers, etc.) advanced between the outer cutter and the inner cutter is cut. In particular, the hair cutting noise and vibration noise caused by the outer cutter and the inner cutter are sensitively felt by the user because the outer cutter is in direct contact with the skin, and directly affect the quality of shaving comfort.

In reciprocating electric shavers, a plurality of arch-shaped cutter blades held in an inner cutter are caused to reciprocate and slide against the lower surface of an arch-shaped outer cutter; for such reciprocating shavers, it has been proposed, as in Japanese Patent Application Laid-Open (Kokai) No. No. 10-323461, that suitable channels be formed in the inner circumferential edges of the circular arcs of the arch-shaped cutter blades, so that the cutter blades can readily vibrate. It is also commonly known, as disclosed in Japanese Patent Application Laid-Open (Kokai) No. 2005-230237 that, so as to adjust the vibration characteristics of the cutter blades, a vibration control unit comprised of, for instance, cut-ins is provided in the tip ends in the length-wise direction of the cutter blades (so as to be near the linking portions connecting the two ends of the cutter blades to the side edges thereof).

FIG. 8 shows a cutter unit used in a conventional rotary electric shaver, FIG. 9 is a side view thereof, and FIG. 10 shows the cross-section at lines 10-10 in FIG. 8.

In this conventional rotary electric shaver, the reference numeral 10 designates an outer cutter, and 12 an inner cutter. The outer cutter 10 is made of metal and is made substantially in a disc shape. The outer circumferential edge thereof is bent so as to be substantially either in a saucer-shape or inverted bowl shape.

In the upper surface of this round outer cutter 10, a multiplicity of slits 14 are formed in the radial direction. The slits 14 constitute hair introduction openings. In the upper surface of the outer cutter 10, a ring-shaped channel 16 is formed; and thus, in the lower surface (inner surface) of the outer cutter 10, two tracks 18 (only one whereof is shown in FIG. 10) comprising concentric circles are formed on both sides of the ring-shaped channel 16.

The inner cutter 12 is comprised of an inner cutter main unit 20 made of a resin and a plurality of cutter blades 22 provided on the inner cutter main unit 20. The cutter blades 22 contact the lower surface (inner surface) of the tracks 18 of the outer cutter 10 and travel while sliding on the inner surface (lower surface) of the tracks 18 when the inner cutter main unit 20 is rotated by the motor. The cutter blades 22, as shown in FIG. 10, are raised up diagonally from the attachment surface 24 which is set on, so to be attached, to the inner cutter main unit 20. More specifically, in FIG. 10, the angle a by which the cutter blades 22 are bent upward is an acute angle, and it is ordinarily 60 to 80°.

In the inner cutter main unit 20 of the inner cutter 12, as seen from FIG. 9, an engagement hole 26 is formed, and a rotary shaft (not shown), parallel to the center axis x of the inner cutter 12, is engaged with this engagement hole 26. The inner cutter 12 is rotationally driven by the rotary shaft in a direction in which the cutter blades 22 travel toward the left (in the direction of the arrow B) in FIG. 10. This rotary shaft has a tendency to return in a direction in which the inner cutter 12 is pushed against the outer cutter 10, and thus this return force is a pushing-up load for pressing the cutter blades 22 in the tracks 18 of the outer cutter 10.

In a reciprocating electric shaver, since the inner cutter moves reciprocally, the cutter blades of the inner cutter are held at right angles with respect to the direction of reciprocation motion. For this reason, it has been possible to configure the shaver so that the inner cutter itself can vibrate.

In a rotary electric shaver, on the other hand, as seen from FIGS. 8, 9, and 10, the cutter blades 22 of the inner cutter 12 are inclined so that the tip ends (cutting edge) are made to precede in the direction of travel of the cutter blades 22 (or in the direction of rotation of the inner cutter 12), thus enhancing the quality of shaving. In such a rotary electric shaver, each cutter blade 22 must have sufficient strength so as not to be bent when cutting hair, and it is also preferred that no irritating noise (buzzing sound) be produced during shaving. For these reasons, the cutter blades are made as rigid as possible to enhance the cutting quality; and more specifically, the thickness β of the cutter blade 22, in FIG. 10, is made large. As a result, since the cutter blades 22 are rigid and do not readily vibrate, it is very difficult to control the sound quality by adjusting the vibration characteristics of the cutter blades 22 by forming channels or the like in the cutter blades 22.

BRIEF SUMMARY OF THE INVENTION

Accordingly, the object of the present invention, devised in view of such circumstances as described above, is to provide an electric shaver of a rotary type in which it is made to be able to control the sound quality without causing the cutter blades of the inner cutter to vibrate.

The above object is accomplished by a unique structure of the present invention for a rotary electric shaver that includes: a substantially disc-shaped outer cutter, which is provided in the upper part of the shaver main body housing therein a motor and is formed with a ring-shaped track(s) on its lower surface, and an inner cutter, which is provided with a cutter blade(s) that elastically contacts the ring-shaped track(s) of the outer cutter from below and is rotationally driven by the motor; and in this electric shaver:

the inner cutter is provided with a vibration element(s) that is in contact at the upper end with the ring-shaped track(s) of the outer cutter and has a smaller spring constant, in a direction which is the same as and opposite from the direction in which the cutter blade(s) travels, than the spring constant of the cutter blade.

As seen from the above, in the shaver of the present invention, a vibration element(s) is provided on the inner cutter(s), and this vibration element(s) has a smaller spring constant in the direction in which the cutter blade(s) travels and in the opposite direction therefrom than that of the cutter blade(s) of the inner cutter(s), and this vibration element(s) is made so as to vibrate while sliding in the ring-shaped track(s) of the outer cutter. Accordingly, by suitably setting the vibration characteristics of the vibration element, the sound quality is enhanced. It is thus also possible to use cutter blades that have sufficiently high rigidity so as to be able to cut the hair efficiently and provide good cutting quality.

The vibration element(s) is formed of a metal sheet, thinner than the cutter blade(s), so that the tip end of the vibration element(s) slides against the ring-shaped track(s); and a straight line joining the flexible bending point of the vibration element and the cutting edge formed on the front edge of the vibration element is set to be substantially parallel to the rotational axis of the inner cutter. In this structure, when the vibration element(s) vibrates forwards and backwards along the ring-shaped track(s), the cutting edge(s) of the vibration element(s) is separated from the ring-shaped track(s); accordingly, there is no danger that the vibration element(s) damages the outer cutter blades (which are the lower edges of ribs located between the hair introduction openings of the outer cutter).

It is preferable that a stopper(s) for limiting the bending extent (or the range of flexibility) of the vibration element(s) be provided on the inner cutter. When the vibration element(s) contact the stopper(s), they produce a pleasant sound, further enhancing the sound quality of the shaver.

In the present invention, the inner cutter can be made of a cup-shaped central base portion, a supporting portion(s) extending in the radial direction from the central base portion, and a cutter blade linking member which is comprised of a plurality of cutter blades linked in a ring shape and is secured to the upper surface(s) of the tip portion(s) of the supporting portion(s); and the vibration element(s) is secured together with the cutter blade linking member to the supporting portion(s) of the inner cutter.

In other words, the cutter blade linking member is comprised of a plurality of cutter blades aligned and integrated in a ring shape. In the present invention, further, a plurality of vibration elements can be linked together in a ring shape to form a vibration element linking member, and this vibration element linking member is superimposed on the cutter blade linking member, so that both linking members are secured to the supporting portion(s) of the inner. The vibration element(s) are preferably provided between the cutter blades, respectively, in the circumferential direction; and the stopper(s) are preferably formed integrally in the vibration element linking member.

It is preferable that the vibration element(s) be curved so that the part below the cutting edge thereof is curved in a direction opposite to the direction in which the vibration element travels. With this structure, when the hair strikes the vibration element(s), the entire vibration element(s) is inclined; and since the curved portion(s) deforms, the hair is caused to smoothly escape. Also, when a vibration element(s) falls over relative to the hair, the hair enters into the concave surface(s) formed by such a curved portion(s); as a result, the vibration element(s) can be inclined smoothly.

The vibration element(s) and the stopper(s) can be formed by bend-machining a common metal sheet, and both the vibration element(s) and the stopper(s) can be formed as a single part, making the shave structure simple.

DETAILED DESCRIPTION OF THE INVENTION

Figure 1:
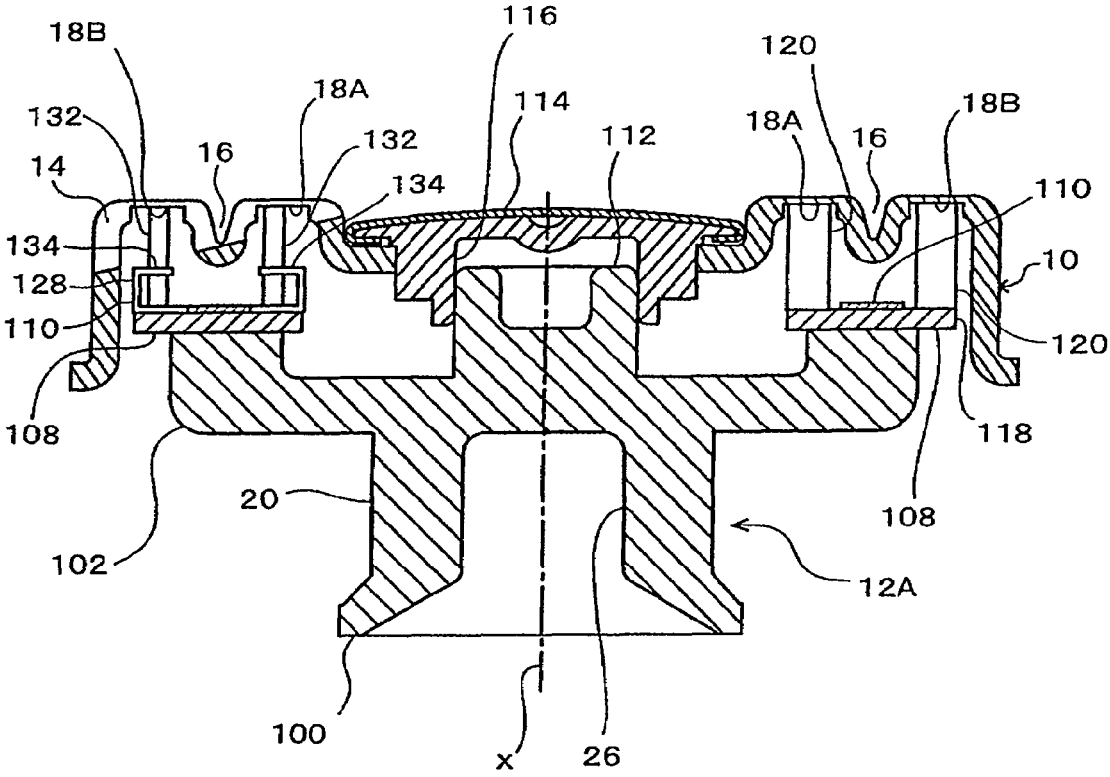
FIG. 1 shows in vertical cross-section a cutter unit according to one embodiment of the present invention.
Figure 2:
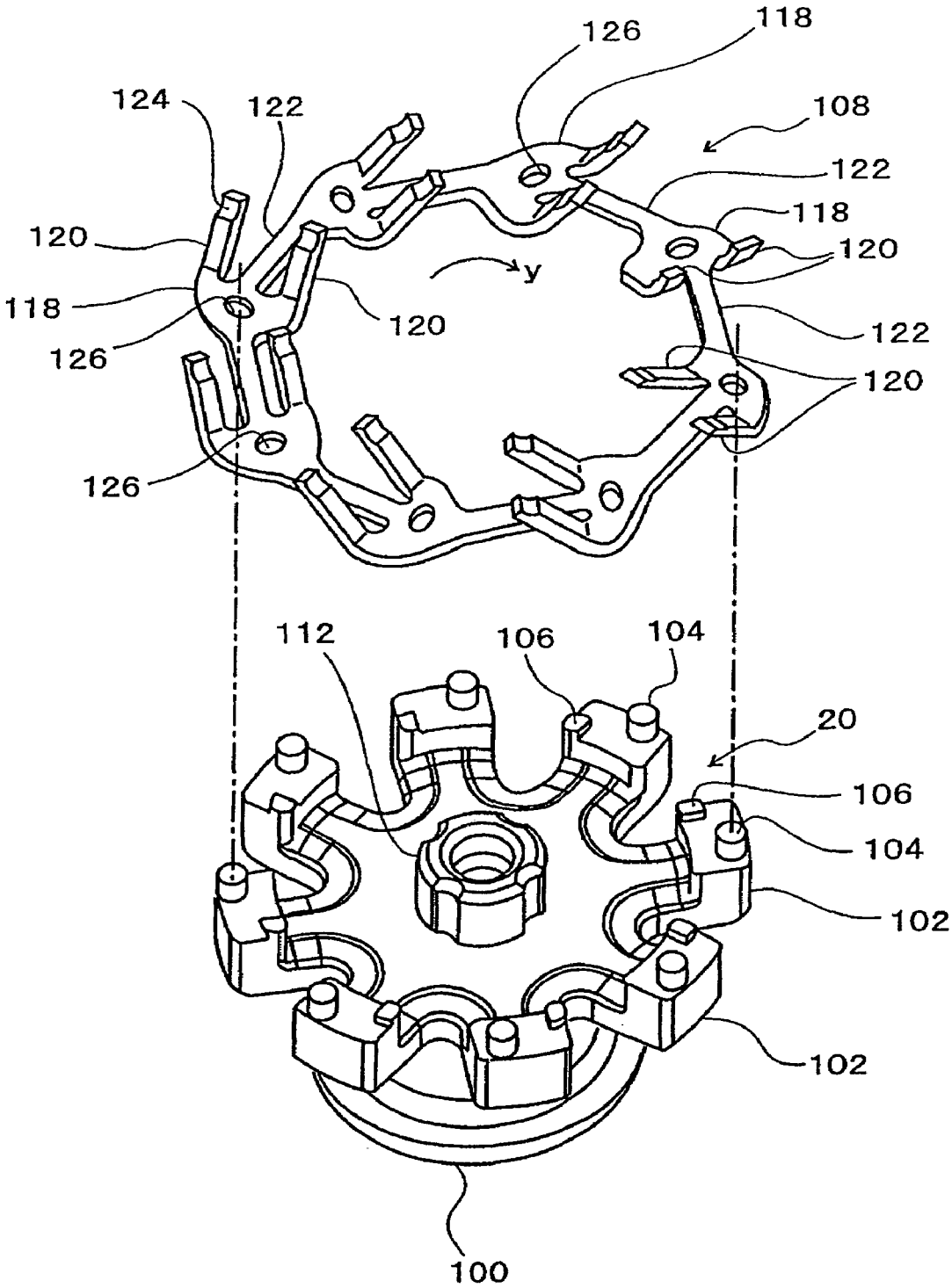
FIG. 2 is an exploded perspective view thereof with vibration element omitted.
Figure 3:
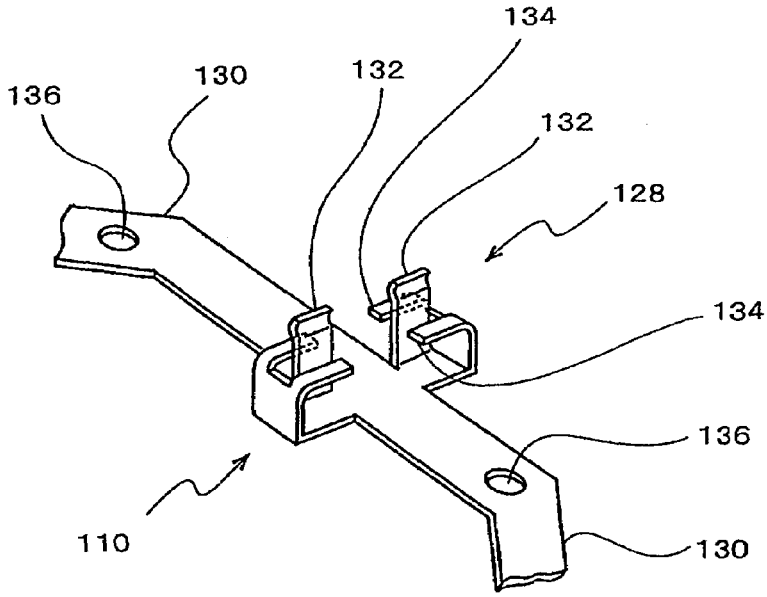
FIG. 3 is a perspective view of a part of a vibration element linking member.
Figure 4:
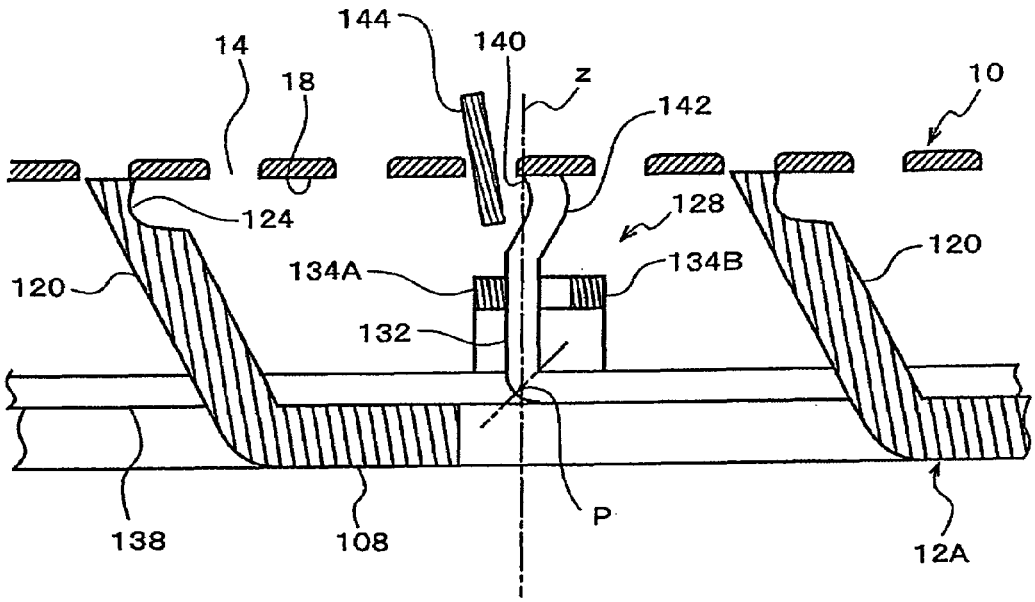
FIG. 4 is a diagram illustrating the action of the vibration element.
Figure 5:
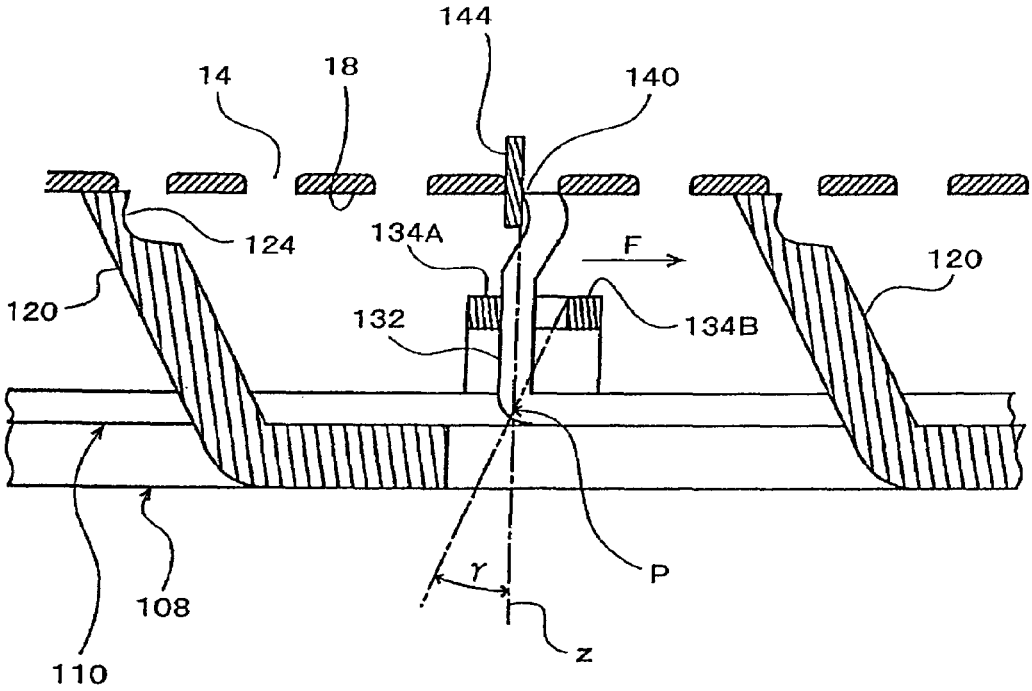
FIG. 5 is a diagram illustrating the action of the vibration element.
Figure 6:
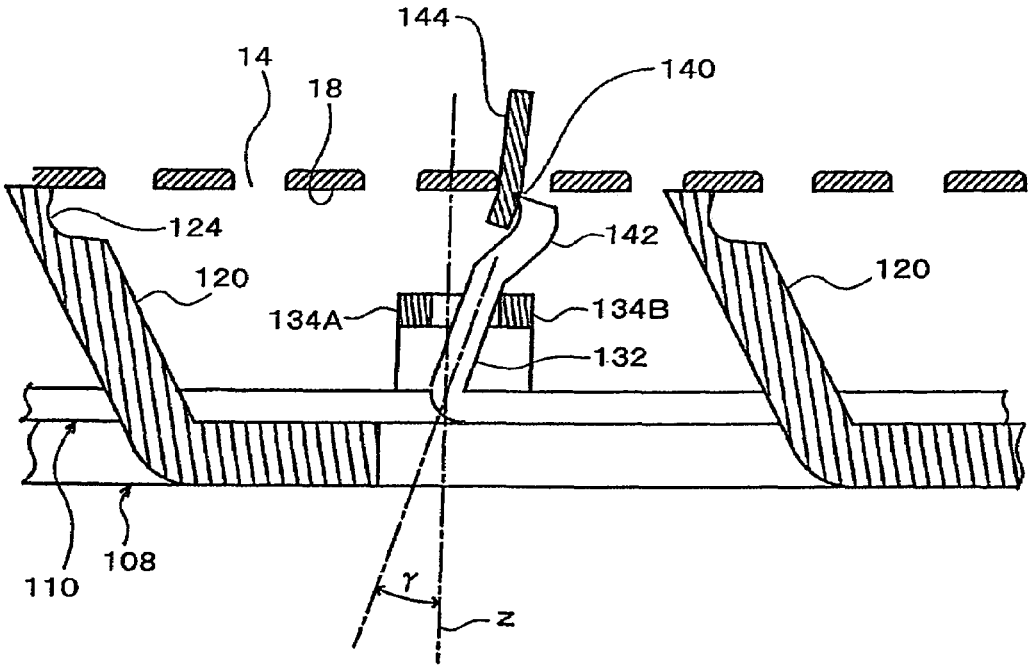
FIG. 6 is a diagram illustrating the action of the vibration element.
Figure 8:
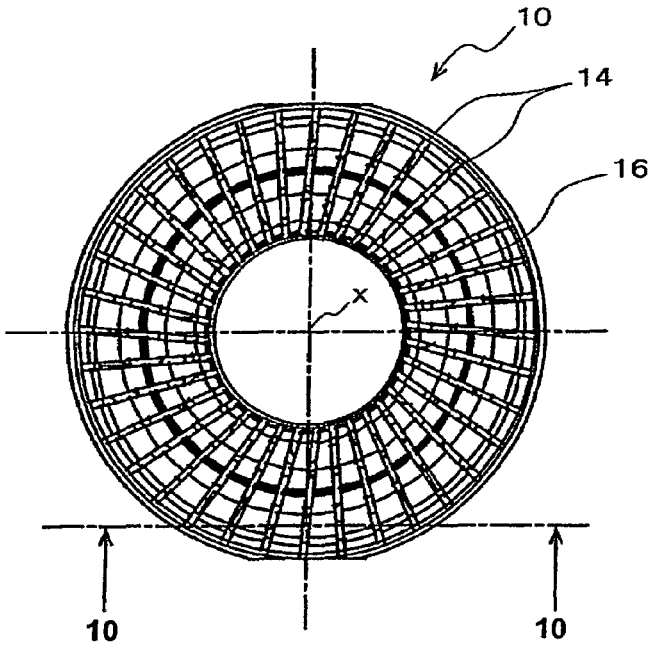
FIG. 8 RELATED ART
FIG. 8 is a top view of a conventional cutter unit.

FIG. 1 shows, in vertical cross-section, the cutter unit according to one embodiment of the present invention, FIG. 2 is a perspective view of the inner cutter with the vibration element(s) removed, FIG. 3 is a perspective view of a part of the vibration element linking member, and FIGS. 4 to 6 illustrate, in vertical cross-section, the action of the vibration element, seen correspondingly along the line 10-10 line in FIG. 8.

Figure 9:
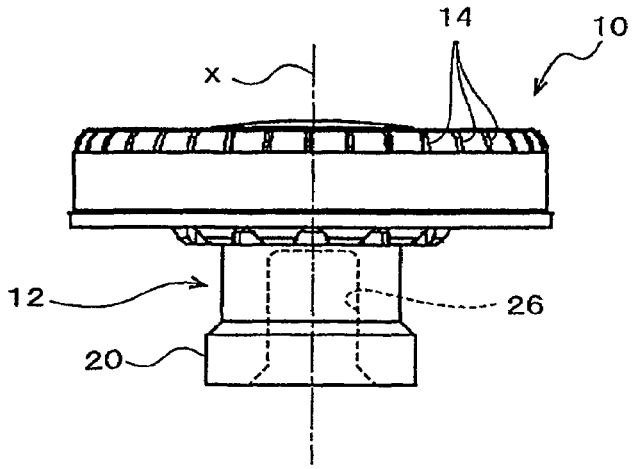
FIG. 9 RELATED ART
FIG. 9 is a side elevation thereof.
Figure 10:
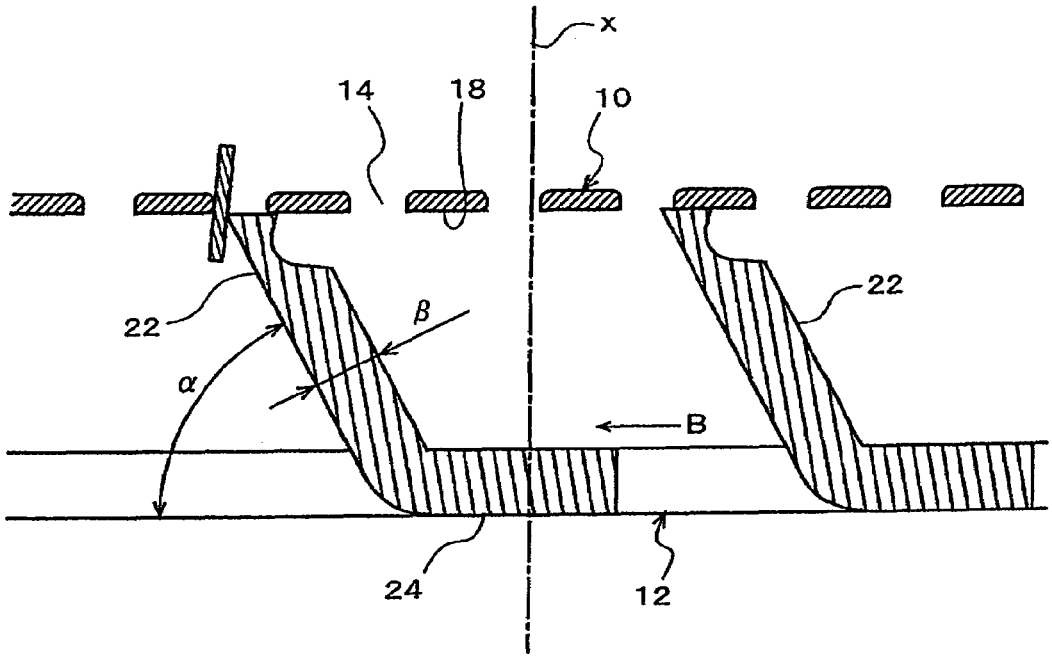
FIG. 10 RELATED ART
FIG. 10 is a cross-sectional view taken along the lines 8-8 in FIG. 8.

In FIG. 1, the same reference numerals are applied to parts that are the same as in FIG. 8 to 10, and descriptions of such same parts are not repeated below. The main difference of the structure of the present invention from the structure of FIGS. 8 and 9 is that vibrating plates 132 are provided between the cutter blades 120 of the inner cutter 12A.

More specifically, the inner cutter main unit 20 of the inner cutter 12A is comprised of, as seen from FIG. 1, a substantially cup-shaped hub (central base unit) 100 and, as seen from FIG. 2, eight supporting portions 102 formed by arms that extend radially outward from the central base unit 100. The central base unit (cup-shaped hub) 100 and the supporting portions 102 are integrally molded of a synthetic resin. The tip portions of all the supporting portions 102 are raised upward, and the upper surfaces thereof are positioned on a plane that lies at right angles to the rotational axis x of the inner cutter 12A.

Projections 104 and 106 protrude from the upper surface of the supporting portions 102 of the inner cutter 12A. The projections (holding projections) 104 are for securing a vibration element linking member 110 and a cutter blade linking plate 108, both will be described below, by hot crimping, while the projections (positioning projections) 106 are for positioning the linking plates 108 and 110. In the center of the upper surface of the inner cutter main unit 20, furthermore, a columnar projecting part 112 is provided as seen from FIG. 1. This projecting part 112 engaging a concavity 116 of a cutter cover 114 secured to the opening made in the center of the outer cutter 10 when the inner cutter 12A is combined with the outer cutter 10, and it prevents the inner cutter 12A from becoming eccentric relative to the outer cutter 10. In other words, the projecting part 112 prevents rotational wobbling in the inner cutter 12A.

The cutter blade linking member 108, as shown in FIG. 2, is comprised of eight substantially Y-shaped cutter units 118 which are linked in a ring shape. More specifically, each one of the substantially Y-shaped cutter units 118 has two cutter blades 120 that are engaged or fitted in two concentric tracks 18A and 18B that are formed in the inner surface of the above-described outer cutter 10 so as to be located on both sides of ring-shaped channel 16, and the plurality of (eight in the shown embodiment) cutter units 118 are linked in a ring shape by linking portions 122 that pass between the cutter blades 120 that are bifurcated in substantially a Y shape. The cutter blades 120, as seen from FIG. 2, are inclined forward toward the rotating direction y (same as direction of arrow B in FIG. 10) of the inner cutter 12A. In each of the surfaces of the cutter blades 120, which is facing the reverse rotating direction (opposite from the rotating direction y), is formed a concavity (recess) 124.

The cutter blade linking member 108 can be obtained by press die-cutting a material such as a metal sheet into substantially a ring shape, and, either thereafter or simultaneously therewith, bending the portions for the cutter blades 120. Cutter unit securing holes 126 are formed in the cutter units 118, and concavities 124 are formed in the cutter blades 120; and these cutter unit securing holes 126 and concavities 124 are formed either simultaneously with the press die-cutting or in a separate process.

Thus, the cutter blade linking member 108 can be formed with a few press machine-pressing process. Also, because the bend machining angle for bending up the cutter blades 120 is small, the stress applied to the metal material will also be small, making it possible to use a metal material with degraded (low) metal material properties (especially the press-machinability).

Next, the vibration element linking member 110 will be described.

This vibration element linking member 110 is formed by pressing or bend-machining a metal sheet that is sufficiently thinner than the cutter blade linking member 108, and it includes eight sound generators 128, as shown in FIG. 3, linked in a ring shape at linking portions 130. The vibration element linking member 110 is stacked on the cutter blade linking member 108 and secured, together with the cutter blade linking member 108, to the inner cutter main unit 20. The sound generators 128 are positioned between the cutter units 118.

Each of the sound generators 128 is comprised of a pair of vibrating plates (vibration elements) 132 and a pair of stoppers 134 which are provided in the vicinity of the vibrating plates (vibration elements) 132. The vibrating plates 132 are formed by bending up metal sheet so that the tips (upper ends) thereof contact the inner surfaces of the tracks 18 (18A and 18B) of the outer cutter 10, and the stoppers 134 are for limiting the range of vibration of the vibrating plates 132. The vibrating plates 132 and the stoppers 134 are formed integrally.

The vibrating plates 132 are capable of vibrating in the circumferential direction of the tracks 18 (in the direction y and in the direction opposite therefrom or in the left and right directions in FIG. 4), and the stoppers 134 are formed, as best seen from FIG. 3, so as to be bifurcated thus sandwiching the vibrating plates 132 from both (front and back) sides of the vibrating plates 132 with gaps on the both sides of each vibrating plate 132.

This vibration element linking member 110 is provided with securing holes 136 in the linking portions 130. The vibration element linking member 110 is set on the cutter blade linking member 108 with the securing holes 136 of the vibration element linking member 110 and the securing holes 126 of the cutter blade linking member 108 aligned, and the vibration element linking member 110 and the cutter blade linking member 108 are mounted on the supporting portions 102 of the inner cutter main unit 20 so that the securing holes 136 of the vibration element linking member 110 and the securing holes 126 of the cutter blade linking member 108 pass through the holding projections 104 of the supporting portions 102.

Then, by hot crimping the tips of the holding projections 104, the linking members 108 and 110 are secured to the inner cutter main unit 20. At this point, the positioning projections 106 formed on the supporting portions 102 are in contact with the side edges of the linking portions 122 and 130, thus positioning the linking members 108 and 110 on the supporting portions 102.

The thus made inner cutter 12A is connected to a rotary shaft (not shown) at its engagement hole 26 (FIG. 1) formed in the central base unit 100 and rotationally driven by a motor (not shown), housed in the shaver body, with respect to the outer cutter 10 (FIG. 1) fitted thereon.

As shown in FIG. 4, each vibrating plate 132 rises substantially vertically relative to the lower surface of the vibration element linking member 110. In other words, the vibrating plate 132 are raised substantially vertically from the attachment surface 138 of the vibration element linking member 110, the attachment surface 138 being the lower surface of the vibration element linking member 110 set on the cutter blade linking member 108. The lower end of each vibrating plate 132 is bent at right angles with a small curvature, and the bent part constitutes a flexible bending point P of the vibrating plate 132. The vibrating plates 132 and the cutter blades 120 travel toward the left in FIGS. 4 to 6.

As seen from FIG. 4, the front (leading) edge of each one of the tips of the vibrating plates 132, on the side toward the direction of travel, makes a cutting edge 140, and a perpendicular straight line z joining the cutting edge 140 and the flexible bending point P is set to be substantially parallel to the rotational axis x of the inner cutter 12A. In other words, the vibrating plates 132 are substantially vertical with respect to the upper surfaces of the supporting portions 102 of the inner cutter main unit 20.

Below the upper end of each one of the vibrating plates 132, that is, below the cutting edge 140, a curved portion 142 is formed. The curved portion 142 is curved so as to be distended from the upper end surface of the vibrating plate 132 in the direction opposite from the direction of travel of the vibrating plate 132.

The vibrating plate linking member 110, after being press and/or bend-machined, is subjected to a suitable heat treatment, so that appropriate flat spring characteristics are imparted. In other words, the spring constant of the vibrating plates 132 in the direction in which the cutter blades travel and in the direction opposite from travel of the cutter blades is sufficiently smaller than the spring constant of the cutter blades 120.

The action of the shaver described above will be explained next below.

When the inner cutter 12A is rotated (in the direction of arrow y in FIG. 2), the cutter blades 120 and the vibrating plates 132 (which are in contact with the lower (inner) surface of the tracks 18 of the outer cutter) are rotated to travel toward the left side in FIG. 4. Before hair 144 enter the slits (hair introduction opening) 14, the vibrating plates 132, due to the spring return force of the vibrating plates 132 themselves, are in contact with the stoppers 134A which are located on the side toward the direction of travel (front side).

When the hair 144 enters the slits 14 immediately before the cutter blades 120 pass by, the hair is cut by the front edges (cutting edges) of the traveling (rotating) cutter blades 120 and the ribs formed between the slits 14 of the outer cutter.

When the hair 144 enters the slits 14 after the cutter blades 120 has passed the slits 14 and before the vibrating plates 132 pass the slits 14, the hair 144 strikes the cutting edges 140 of the vibrating plates 132. FIG. 5 shows this situation.

When the hair 144 strikes the cutting edges 140 of the vibrating plates 132, as seen from FIG. 5, a force F acting in the reverse travel direction (toward the back) is applied to the upper ends of the vibrating plates 132 by the shear resistance of the hair 144. As a result, the vibrating plates 132 begin to incline in the reverse travel direction (toward the back side) about the flexible bending points P of the vibrating plates 132. Then, when this force F increases as the inner cutter 12A rotates, the vibrating plates 132 incline further, strike the stoppers (rear stoppers) 134B which are located on the rearward side with respect to the direction of travel (back side) of the vibrating plates 132 and cutter blades 120 (or located on the reverse traveling direction), and produce sound. The fall-over angle at this moment is shown by γ. FIG. 6 illustrates this situation.

When the vibrating plates 132 attain the fall-over angle γ, they are in contact with the rear stoppers 134B and are supported thereby; and after the hair 144 is sheared (cut) by the cutting edges 140 of the vibrating plates 132, the force F is released. The vibrating plates 132, released from the hair 144, return to the vertical position shown in FIG. 4 due to the spring characteristics of the vibrating plates 132 themselves. As a result, the vibrating plates 132 strike the front stoppers 134A, which are located on the forward side with respect to the direction of travel (front side) of the vibrating plates 132 and cutter blades 120, and again produce sound.

As seen from the above, the vibrating plates 132 incline every time hair 144 which enters the slits 14 strikes them, and they strike the front and rear stoppers 134 and produce sound. Accordingly, the sound quality can be changed or improved by setting the vibration characteristics of the vibrating plates 132 and/or the stoppers 134. In other words, different sounds can be produced by shavers with the use of vibrating plates and/or stoppers of, for instance, different sizes, thicknesses and materials; and the number of vibrating plates and/or stoppers installed can be varied.

In the above structure, the cutting edge 140 at the upper end of each one of the vibrating plates 132 is positioned near the perpendicular straight line z that passes through the flexible bending point P. Accordingly, when the vibrating plate vibrates, the angle at which the cutting edge 140 contacts the lower surface of the track 18 becomes close to parallel to the lower surface of the track 18; and as a result, there is no danger that the cutting edges of the outer cutter 10 formed at the edges of the slits 14 will be damaged.

Figure 7:
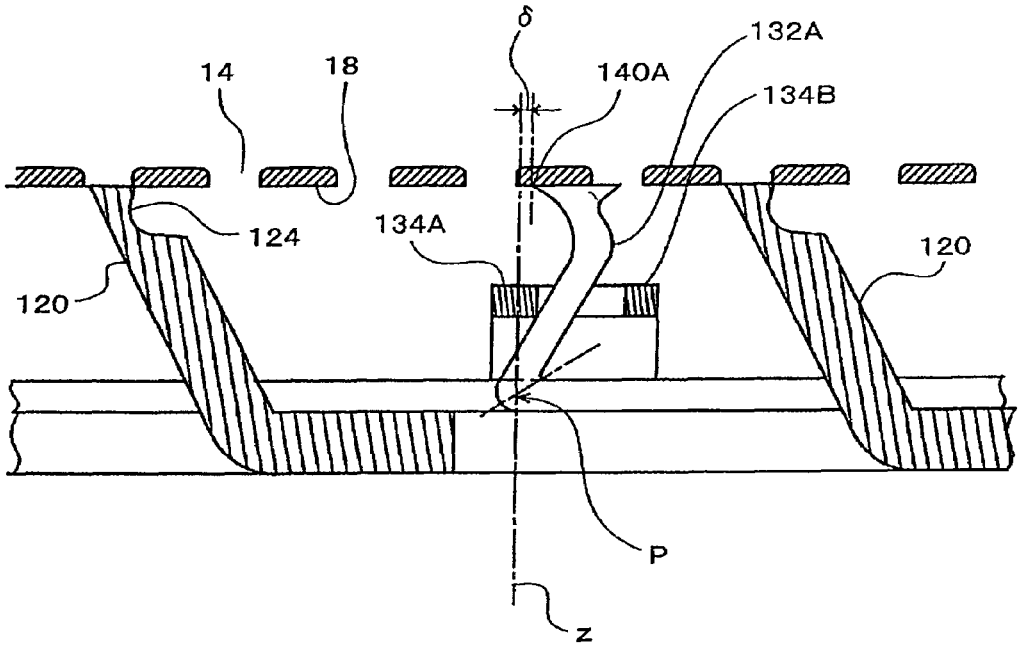
FIG. 7 shows another embodiment of the present invention.

FIG. 7 shows, in vertical cross-section, another embodiment of the present invention, seen correspondingly along the line 10-10 line in FIG. 8. In this embodiment of FIG. 7, the vibrating plates 132 have different shape from that of FIGS. 4 to 6.

More specifically, each one of the vibrating plates 132A is curved with a radius of curvature that is larger toward the back (reverse travel direction) from the flexible bending point P; and in a condition that the vibrating plate 132A is in contact with the front stopper 134A, the position of the cutting edge 140A, which is the front edge of the upper end (tip) of the vibrating plate 132A, is displaced toward the back side by a distance δ from the perpendicular line y that passes through the flexible bending point P.

In the structure of FIG. 7, after the vibrating plate 132A has fallen over toward the back, when it returns to the (original) position of FIG. 7, it strikes the front stopper 134A and thus its return position is limited. At that time, the cutting edge 140A is displaced by δ toward the back from the flexible bending point P; as a result, the cutting edge 140A of the vibrating plate 132A can be even more definitely prevented from damaging the blades in the tracks 18 of the outer cutter.

The invention claimed is:

1. A rotary electric shaver comprising a substantially disc-shaped outer cutter, which is provided in an upper part of a shaver main body housing therein a motor and is formed with a ring-shaped track on a lower surface thereof, and an inner cutter, which is provided with a cutter blade that elastically contacts said ring-shaped track of said outer cutter from below and is rotationally driven by said motor; wherein:

said inner cutter is provided with a vibration element wherein said vibration element is in contact with said ring-shaped track of said outer cutter, said vibration element has a smaller spring constant, in a direction in which the cutter blade travels and in a direction opposite from a direction in which said cutter blade travels, than a spring constant of said cutter blade of said inner cutter and said vibration element is separate from and not in contact with said inner cutter;

said inner cutter is comprised of:

a cup-shaped central base portion, a supporting portion extending in a radial direction from said central base portion, and a cutter blade linking member which is comprised of a plurality of cutter blades linked in a ring shape and is secured to an upper surface of a tip portion of said supporting portion; and said vibration element is secured together with said cutter blade linking member to said supporting portion of said inner cutter;

a vibration element linking member which is comprised of a plurality of vibration elements linked in a ring shape is superimposed on said cutter blade linking member and secured to said supporting portion of said inner;

a stopper is formed integrally with said vibration element linking member; and the stopper comprises a front stopper provided in front of said vibration element in a direction of rotation and a rear stopper provided in back of said vibration element in a direction of rotation whereby said vibration element strikes both the front and rear stoppers to produce a sound.

2. A rotary electric shaver comprising a substantially disc-shaped outer cutter, which is provided in an upper part of a shaver main body housing therein a motor and is formed with a ring-shaped track on a lower surface thereof, and an inner cutter, which is provided with a cutter blade that elastically contacts said ring-shaped track of said outer cutter from below and is rotationally driven by said motor; wherein:

a vibration element is provided adjacent said inner cutter wherein said vibration element is in contact with said ring-shaped track of said outer cutter, said vibration element has a smaller spring constant, in a direction in which the cutter blade travels and in a direction opposite from a direction in which said cutter blade travels, than a spring constant of said cutter blade of said inner cutter and said vibration element is separate from and not in contact with said inner cutter.

3. The rotary electric shaver according to claim 2, wherein said vibration element is formed of a metal sheet, thinner than said cutter blade, so that a tip end thereof slides against said ring-shaped track, and a straight line joining a flexible bending point of said vibration element and a cutting edge formed on a front edge of said vibration element is set to be substantially parallel to a rotational axis of said inner cutter.

4. The rotary electric shaver according to claim 3, wherein said vibration element is curved so that an end portion below the cutting edge thereof is curved in a direction opposite to a direction in which said vibration element travels.

5. The rotary electric shaver according to claim 2, wherein a stopper for limiting bending of said vibration element is provided on said inner cutter.

6. The rotary electric shaver according to claim 5, wherein said vibration element and said stopper are formed from a common metal sheet.

7. The rotary electric shaver according to claim 5, wherein said vibrating element and said stopper are provided adjacent to each other so that during rotation of said inner cutter said vibrating element vibrates and strikes said stopper to produce sound.

8. The rotary electric shaver according to claim 2, wherein said inner cutter is comprised of:

a cup-shaped central base portion, a supporting portion extending in a radial direction from said central base portion, and a cutter blade linking member which is comprised of a plurality of cutter blades linked in a ring shape and is secured to an upper surface of a tip portion of said supporting portion; and said vibration element is secured together with said cutter blade linking member to said supporting portion of said inner cutter.

9. The rotary electric shaver according to claim 8, wherein a vibration element linking member which is comprised of a plurality of vibration elements linked in a ring shape is superimposed on said cutter blade linking member and secured to said supporting portion of said inner.

10. The rotary electric shaver according to claim 9, wherein a stopper is formed integrally with said vibration element linking member.

11. The rotary electric shaver according to claim 9, wherein said vibration element is substantially vertical to said vibration element linking member.

* * * * *